United States Patent [19]

Brupbacher et al.

[11] Patent Number: 4,772,452

[45] Date of Patent: Sep. 20, 1988

[54] PROCESS FOR FORMING METAL-SECOND PHASE COMPOSITES UTILIZING COMPOUND STARTING MATERIALS

[75] Inventors: John M. Brupbacher; Leontios Christodoulou, both of Baltimore; Dennis C. Nagle, Ellicott City, all of Md.

[73] Assignee: Martin Marietta Corporation, Bethesda, Md.

[21] Appl. No.: 33,710

[22] Filed: Apr. 3, 1987

Related U.S. Application Data

[63] Continuation-in-part of Ser. No. 943,899, Dec. 19, 1986, Pat. No. 4,710,348, which is a continuation of Ser. No. 662,928, Oct. 19, 1984, abandoned.

[51] Int. Cl.[4] ..... C27C 1/00; C21B 15/00

[52] U.S. Cl. ..... 420/129; 420/590

[58] Field of Search ..... 420/129, 590

[56] References Cited

U.S. PATENT DOCUMENTS

| | | | |
|---|---|---|---|
| 2,852,366 | 9/1958 | Jenkins | 75/201 |
| 3,194,656 | 7/1965 | Vordahl | 75/135 |
| 3,415,697 | 12/1968 | Bredzs et al. | 149/109 |
| 3,547,673 | 12/1970 | Bredzs et al. | 117/22 |
| 3,666,436 | 5/1972 | Bredzs et al. | 75/0.5 R |
| 3,672,849 | 6/1972 | Bredzs et al. | 29/195 |
| 3,690,849 | 9/1972 | Bredzs et al. | 29/182.5 |
| 3,690,875 | 9/1972 | Bredzs et al. | 75/202 |
| 3,705,791 | 12/1972 | Bredzs et al. | 29/195 |
| 3,726,643 | 4/1983 | Merzhanov et al. | 423/409 |
| 3,785,807 | 1/1974 | Backerud | 75/138 |
| 3,801,308 | 4/1974 | Gustison | 75/129 |
| 4,161,512 | 7/1979 | Merzhanov et al. | 423/440 |
| 4,431,448 | 2/1984 | Merzhanov et al. | 75/238 |
| 4,444,603 | 4/1984 | Yamatsuta et al. | 148/127 |
| 4,514,268 | 4/1985 | De Angelis | 204/67 |
| 4,540,546 | 9/1985 | Giessen | 420/590 |

*Primary Examiner*—Christopher W. Brody

*Attorney, Agent, or Firm*—Herbert W. Mylius; Gay Chin

[57] ABSTRACT

This invention relates to a process for making composite materials involving the in-situ precipitation of second phase particles in a metal matrix, and the products thereof. The process involves the use of initial compound materials as a source of second phase-forming reactants in the production of metal-second phase composites. The composites produced may comprise distributions of either single or multiple second phase materials. Exemplary initial compound precursors include boron nitride, boron carbide, boron oxide, aluminum nitride, aluminum carbide, aluminum boride, iron oxide and copper oxide.

52 Claims, No Drawings

PROCESS FOR FORMING METAL-SECOND PHASE COMPOSITES UTILIZING COMPOUND STARTING MATERIALS

This is a continuation-in-part of Ser. No. 943,899 filed Dec. 19, 1986 now U.S. Pat. No. 4,710,348 which is a continuation of application Ser. No. 662,928, filed Oct. 19, 1984, now abandoned.

FIELD OF THE INVENTION

The present invention relates generally to the production of metal-second phase composites. The process for making such composites comprises reaction of second phase-forming reactants in the presence of a solvent metal to form a distribution of either single or multiple second phase materials throughout a matrix of the solvent metal. The present invention utilizes compound materials as a source of second phase-forming reactants in the production of the desired second phase materials. Generally, at least one reactant provided from the starting compound is a metal and acts as a metal source for the new second phase material formed. The metal source may comprise the metal component of ceramics such as oxides, borides, nitrides, carbides, aluminides, silicides, and the like of one or more metals, or mixtures thereof. Exemplary of such ceramics are boron nitride, boron carbide, silicon carbide, silicon nitride, and aluminum nitride. The metal source may also comprise metal components of additional compounds such as boron oxide, copper oxide, iron oxide, aluminum boride, and aluminum carbide. Further, the metal source may comprise at least one metal component of intermetallic compounds such as titanium aluminides and nickel aluminides.

In the present invention, the second phase material which is produced by a solvent assisted reaction is dispersed in a solvent matrix metal, metal alloy, or intermetallic compound, forming a composite, typically in the form of a porous sponge, which can be introduced into a molten host metal bath to disperse the second phase throughout the host metal. Cooling yields a final composite having improved properties due to, for example, uniform dispersion of the very small particulate second phase throughout the final metal matrix, and the resultant fine grain size of the matrix. Either the solvent matrix metal or the host metal, or both, may constitute an alloy of two or more metals, and the solvent metal may be the same as, or different than, the host metal. The solvent metal should be soluble in the host metal, or capable of forming an alloy or intermetallic therewith.

BACKGROUND OF THE INVENTION

For the past several years, extensive research has been devoted to the development of metal-second phase composites, such as aluminum reinforced with fibers, whiskers, or particles of carbon, boron, silicon carbide, silica, or alumina. Metal-second phase composites with good high temperature yield strengths and creep resistance have been fabricated by the dispersion of very fine (less than 0.1 micron) oxide or carbide particles throughout the metal or alloy matrix of composites formed, utilizing powder metallurgy techniques. However, such composites typically suffer from poor ductility and fracture toughness, for reasons which are explained below.

Prior art techniques for the production of metal-second phase composites may be broadly categorized as powder metallurgical approaches, molten metal techniques, and internal oxidation processes. The powder metallurgical production of dispersion-strengthened composites would ideally be accomplished by mechanically mixing metal powders of approximately 5 micron diameter or less with an oxide or carbide powder (preferably 0.01 micron to 0.1 micron). High speed blending techniques, or conventional procedures such as ball milling, may be used to mix the powders. Standard powder metallurgy techniques are then used to form the final composite. Conventionally, however, the ceramic component is large, i.e., greater than 1 micron, due to a lack of availability, and high cost, of very small particle size materials, because their production is energy and capital intensive, and time consuming. Furthermore, production of very small particles inevitably leads to contamination at the particle surface, resulting in contamination at the particle-to-metal interface in the composite, which in turn compromises the mechanical properties thereof. Also, in many cases where the particulate materials are available in the desired size, they are extremely hazardous due to their pyrophoric nature.

Alternatively, molten metal infiltration of a continuous skeleton of the second phase material has been used to produce composites. In some cases, elaborate particle coating techniques have been developed to protect ceramic particles from molten metal during molten metal infiltration and to improve bonding between the metal and ceramic. Techniques such as this have been developed to produce silicon carbide-aluminum composites, frequently referred to as SiC/Al or SiC aluminum. This approach is suitable for large particulate ceramics (for example, greater than 1 micron) and whiskers. The ceramic material, such as silicon carbide, is pressed to form a compact, and liquid metal is forced into the packed bed to fill the intersticies. Such a technique is illustrated in U.S. Pat. No. 4,444,603 to Yamatsuta et al, hereby incorporated by reference. Because this technique necessitates molten metal handling and the use of high pressure equipment, molten metal infiltration has not been a practical process for making metal-second phase composites, especially for making composites incorporating submicron ceramic particles, where press size and pressure needs would be excessive and impractical.

The presence of oxygen in ball-milled powders used in prior art powder metallurgy techniques, or in molten metal infiltration, can result in a deleterious layer, coating, or contamination such as oxide at the interface of second phase and metal. The existence of such layers will inhibit interfacial binding between the second phase and the metal matrix, adversely effecting ductility of the composite. Such weakened interfacial contact may also result in reduced strength, loss of elongation, and facilitated crack propagation.

Internal oxidation of a metal containing a more reactive component has also been used to produce dispersion strengthened metals, such as copper containing internally oxidized aluminum. For example, when a copper alloy containing about 3 percent aluminum is placed in an oxidizing atmosphere, oxygen may diffuse through the copper matrix to react with the aluminum, precipitating alumina. Although this technique is limited to relatively few systems, because the two metals must have a wide difference in chemical reactivity, it has offered a possible method for dispersion hardening. However, the highest possible concentration of dispersoids formed in the resultant dispersion strengthened metal is generally insufficient to impart significant changes in properties such as modulus, hardness and the like.

In U.S. Pat. No. 2,852,366 to Jenkins, hereby incorporated by reference, it is taught that up to 10 percent by weight of a metal complex can be incorporated into a base metal or alloy. The patent teaches blending, pressing, and sintering a mixture of a base metal, a compound of the base metal and a non-metallic complexing element, and an alloy of the base metal and the complexing metal. Thus, for example, the reference teaches mixing powders of nickel, a nickel-boron alloy, and a nickel-titanium alloy, pressing, and sintering the mixed powders to form a coherent body in which a stabilizing unprecipitated "complex" of titanium and boron is dispersed in a nickel matrix. Precipitation of a ceramic phase is specifically avoided.

In U.S. Pat. No. 3,194,656, hereby incorporated by reference, Vordahl teaches the formation of a ceramic phase, such as $TiB_2$ crystallites, by melting a mixture of eutectic or near eutectic alloys. It is essential to the process of Vordahl that at least one starting ingredient has a melting point substantially lower than that of the matrix metal of the desired final alloy. There is no disclosure of the initiation of an exothermic second phase-forming reaction at or near the melting point of the matrix metal.

Bredzs et al, in U.S. Pat. Nos. 3,415,697, 3,547,673, 3,666,436, 3,672,849, 3,690,849, 3,690,875, and 3,705,791, hereby incorporated by reference, teach the preparation of cermet coatings, coated substrates, and alloy ingots, wherein an exothermic reaction mechanism forms an in-situ precipitate dispersed in a metal matrix. Bredzs et al rely on the use of alloys having a depressed melting temperature, preferably eutectic alloys, and thus do not initiate a second phase-forming exothermic reaction at or near the melting temperature of the matrix metal.

DeAngelis, in U.S. Pat. No. 4,514,268, hereby incorporated by reference, teaches reaction sintered cermets having very fine grain size. The method taught involves the dual effect of reaction between and sintering together of admixed particulate reactants that are shaped and heated at temperatures causing an exothermic reaction to occur and be substantially completed. The reaction products are sintered together to form ceramic-ceramic bonds by holding the reaction mass at the high temperatures attained. Thus, this reference relates to a product with sintered ceramic bonds suitable for use in contact with molten metal.

Backerud, in U.S. Pat. No. 3,785,807, hereby incorporated by reference, teaches the concept of preparing a master alloy for aluminum, containing titanium diboride. The patentee dissolves and reacts titanium and boron in molten aluminum at a high temperature, but requires that titanium aluminide be crystallized at a lower temperature around the titanium diboride formed. Thus, the patent teaches formation of a complex dispersoid.

In recent years, numerous ceramics have been formed using a process termed "self-propagating high-temperature synthesis" (SHS). It involves an exothermic, self-sustaining reaction which propagates through a mixture of compressed powders, typically for the purpose of preparing ceramic powders or parts, absent a metal binder. The SHS process involves mixing and compacting powders of the constituent elements and igniting a portion of a green compact with a suitable heat source. The source can be electrical impulse, laser, thermite, spark, etc. On ignition, sufficient heat is released to support a self-sustaining reaction, which permits the use of sudden, low power initiation at high temperatures, rather than bulk heating over long periods at lower temperatures. Exemplary of these techniques are the patents of Merzhanov et al, U.S. Pat. Nos. 3,726,643; 4,161,512; and 4,431,448 among others, hereby incorporated by reference.

In U.S. Pat. No. 3,726,643, there is taught a method for producing high-melting refractory inorganic compounds by mixing at least one metal selected from Groups IV, V, and VI of the Periodic System with a non-metal, such as carbon, boron, silicon, sulfur, or liquid nitrogen, and heating the surface of the mixture to produce a local temperature adequate to initiate a combustion process. In U.S. Pat. No. 4,161,512, a process is taught for preparing titanium carbide by ignition of a mixture consisting of 80–88 percent titanium and 20–12 percent carbon, resulting in an exothermic reaction of the mixture under conditions of layer-by-layer combustion. These references deal with the preparation of ceramic materials, absent a binder.

When the SHS process is used with an inert metal phase, it is generally performed with a relatively high volume fraction of ceramic and a relatively low volume fraction of metal (typically 10 percent and below, and almost invariably below 30 percent). The product is a dense, sintered material wherein the relatively ductile metal phase acts as a binder or consolidation aid which, due to applied pressure, fills voids, etc., thereby increasing density. The SHS process with inert metal phase occurs at higher temperatures than the in-situ precipitation process used in conjunction with the present invention, and is non-isothermal, yielding sintered ceramic particles having substantial variation in size.

U.S. Pat. No. 4,431,448 teaches preparation of a hard alloy by intermixing powders of titanium, boron, carbon, and a Group I-B binder metal or alloy, such as an alloy of copper or silver, compression of the mixture, local ignition thereof to initiate the exothermic reaction of titanium with boron and carbon, and propagation of the reaction, resulting in an alloy comprising titanium diboride, titanium carbide, and up to about 30 percent binder metal. This reference, however, is limited to the use of Group I-B metals or alloys, such as copper and silver, as binders. Products made by this method have low density, and are subjected to subsequent compression and compaction to achieve a porosity below 1 percent.

U.S. Pat. No. 4,540,546 to Giessen et al, hereby incorporated by reference, teaches a method for rapid solidification processing of a multiphase alloy. In this process two starting alloys react in a mixing nozzle in which a "Melt Mix Reaction" takes place between chemically reactable components in the starting alloys, to form submicron particles of the resultant compound in the final alloy. The mixing and chemical reaction are performed at a temperature which is at or above the highest liquidus temperature of the starting alloys, but which is also substantially below the liquidus temperature of the final alloy, and as close to the solidus temperature of the final alloy as possible. While dispersion-strengthened alloys can be produced by this technique, there appear to be a number of inherent difficulties. First, processing is technically complex, requiring multiple furnaces. Second, efficient mixing is important if fine dispersions are to be consistently produced. Lastly, very high degrees of superheat will be required to completely dissolve the rapid solidification alloying elements in order to produce high loading of dispersoid, which necessarily accentuates particle growth, for example, in composites containing 10–20% dispersoid.

The present invention overcomes the disadvantages of the prior art noted above. More particularly, the present invention permits simplification of procedures and equipment compared to the prior art. For example, the present process obviates the need for multiple furnaces and mixing and control equipment because all of the constituents of the second phase are present in a single reaction vessel. The present invention also overcomes the need for forming multiple melts of components at very high melting temperatures. Further, high loading composites can be prepared without the necessity of achieving high levels of superheat in holding furnaces.

Applicants' invention also provides for a cleaner particle/metal interface compared with conventional metal-ceramic composites made by, for example, powder metallurgical techniques using separate metal and ceramic powders, because the reinforcing particles are formed in-situ.

The invention is further advantageous over conventional technology because it uses low cost starting materials. The invention also provides a mechanism for producing metal-second phase composites containing carbides and nitrides and a mechanism for producing mixed second phase precipitates, for example, mixed ceramic precipitates such as $TiB_2$/TiN, or mixed ceramic/intermetallic precipitates such as $TiB_2$/TiAl. Applicants' process may also produce dispersions of second phase materials not normally wet by metals, for example, $TiO_2$ in aluminum. With these facts in mind, a detailed description of the invention follows.

SUMMARY OF THE INVENTION

An object of the present invention is the use of compound starting materials as a source of second phase-forming reactants in the production of metal-second phase composite materials. The process of the present invention comprises contacting second phase-forming reactants in the presence of a substantially nonreactive solvent metal in which the second phase-forming reactants are more soluble than the second phase material, at a temperature at which sufficient diffusion of the reactants into the solvent metal occurs to cause a second phase-forming reaction of the reactants to thereby precipitate second phase material in the solvent metal, wherein at least one second phase-forming reactant is provided from at least one compound precursor material.

The present invention relates to a process for the in-situ precipitation of up to about 95 percent by volume of second phase material in a solvent metal matrix, wherein the second phase can comprise at least one ceramic, such as a boride, carbide, oxide, nitride, silicide, oxysulfide, or sulfide, of a metal the same as or other than the solvent metal matrix. It has been found that by mixing at least one initial compound material comprising primary second phase-forming reactants with secondary second phase-forming reactants and a solvent metal, and then heating to a temperature at which substantial diffusion and/or dissolution of the second phase-forming reactants into the solvent metal can occur, typically at or close to the melting point of the solvent metal, a solvent assisted reaction, which is always exothermic, can be initiated. Alternatively, it has been found that by mixing at least two initial compounds, each comprising at least one primary second phase-forming reactant, with a solvent metal, and then heating to a temperature at which substantial diffusion and/or dissolution of at least one of the primary second phase-forming reactants into the solvent metal can occur, a solvent assisted exothemic reaction can be initiated. In each case, the solvent assisted reaction results in the extremely rapid formation and dispersion of finely divided particles of the second phase material in the solvent metal.

The present invention also relates to a composite material containing a preformed dispersion of in-situ precipitated second phase particles in a solvent metal matrix, produced by reacting at least one primary second phase-forming reactant and at least one secondary second phase-forming reactant in the presence of a solvent metal in which the reactants are more soluble than the second phase, wherein the primary reactant is provided from at least one member of the group consisting of borides, carbides, nitrides, oxides, silicides and aluminides.

The present invention may produce a composite comprising a relatively concentrated second phase dispersion in a solvent metal matrix, which may be the same or different than the final metal matrix desired. This concentrated composite may be utilized to form improved final metal matrix-second phase composites of lower second phase concentration, having a substantially uniform dispersion of second phase particles of relatively uniform size, by admixture with a desired host metal, metal alloy or intermetallic matrix material.

DESCRIPTION OF THE PREFERRED EMBODIMENTS

The present invention is directed to metal-second phase composites and a process for their preparation utilizing compound starting materials to form desired second phase materials in metal matrices using an in-situ precipitation process. Overall, it is the purpose of the present disclosure to describe an approach to producing metal-second phase materials using relatively inexpensive compounds as a source of second phase-forming reactants. Further, it is the purpose of the present disclosure to describe the production of composite materials having distributions of either single or multiple second phase materials throughout a solvent metal matrix. Thus, it is an object of the present invention to form composite materials by a less complex method using economical compound starting materials to produce metal-second phase composites with improved physical and mechanical properties compared to those produced by known techniques.

The method and product of the present invention are surprising because compound raw materials, such as ceramics and intermetallics, are an unlikely source of second phase-forming reactants, since their melting points are typically very high. Further, wetting of ceramics by metals, particularly the wetting of oxides, is normally a problem. Both of these factors generally retard reaction kinetics. The advantages of the present method and product of this invention mentioned above will become more readily understood by consideration of the following description and examples.

The solvent assisted in-situ precipitation technique is described in detail in parent application Ser. No. 943,899, hereby incorporated by reference, filed Dec.

19, 1986, of which this application is a continuation-in-part, and which in turn is a continuation of application Ser. No. 662,928, filed Oct. 19, 1984, now abandonded. The solvent assisted in-situ precipitation technique is also described in detail in application Ser. Nos. 927,014, 927,031, and 927,032, hereby incorporated by reference, filed Nov. 5, 1986.

The in-situ precipitation techniques described in the preceeding applications overcome many of the problems of prior art techniques but frequently involve the use of relatively expensive elemental powders as starting materials. The process of the present invention provides an inexpensive alternative to the previous methods by utilizing low cost compound materials as a source of second phase-forming reactants. The process of the present invention also provides a method for producing metal-second phase composites comprising multiple second phase particulates of differing composition, size, morphology, amount, etc. Thus, composites may be produced having, for example, a bimodal distribution of second phase particulates comprising essentially equiaxed particles of one composition, and needle shaped particles of differing composition, resulting in a combination of dispersion strengthening and high temperature creep resistance. Additionally, the present invention provides a unique method for producing oxides, nitrides, etc., in an in-situ precipitation process without the use of gas, thus avoiding associated problems such as diffusion limitations. Also, the process of the present invention allows for the in-situ production and essentially complete dispersion of second phase particles, such as oxides and nitrides, which are typically non-wet by molten metal, avoiding the "non-wetting type segregation" found in previous methods.

Exemplary starting compounds include ceramics such as boron nitride, boron carbide, silicon carbide, silicon nitride, and aluminum nitride, and intermetallics such as titanium aluminide and nickel aluminide. Additional starting compounds include boron oxide, copper oxide, iron oxide, aluminum carbide and aluminum boride.

A novel process is taught for the in-situ precipitation of fine particulate second phase materials including ceramics or intermetallics, such as refractory hard metal borides or aluminides, within metal and alloy systems to produce metal-second phase composites. The process described may utilize inexpensive raw materials to form desirable discrete ceramic or intermetallic particulate second phases in a metal matrix.

A method is taught herein whereby at least one compound material, comprising at least one primary second phase forming reactant, is caused to react with at least one secondary second phase-forming reactant in the presence of a solvent metal to form a finely-divided dispersion of desirable second phase material in a matrix of the solvent metal. In accordance with the present invention, primary second phase-forming reactants, derived from the initial compound, and secondary second phase-forming reactants most easily combine at or about the melting temperature of the solvent metal, and the exothermic nature of this reaction causes a very rapid temperature elevation or spike, which has the effect of melting additional metal, simultaneously promoting the further reaction of second phase-forming reactants. The mechanism by which the primary second phase-forming reactants are obtained from the initial compound will vary with the specific system, but may entail, for example, decomposition of the initial compound into the solvent metal to form dissolved elemental species, or attack on the initial compound by the secondary second phase-forming reactant. In the latter case, it is only necessary for the secondary second phase-forming reactant, and not the primary second phase-forming reactants, to be substantially soluble or to diffuse in the solvent metal.

A method is also disclosed herein whereby at least two compound materials, each comprising at least one primary second phase-forming reactant, are contacted in the presence of a solvent metal to cause a reaction of the primary second phase-forming reactants, thereby forming a finely-divided dispersion of desirable second phase material in a matrix of the solvent metal.

In systems where the reactive elements have substantial diffusivity in the solid solvent metal, the reaction may be initiated at temperatures below the melting point of the solvent metal. Thus, a solid state initiation is possible, wherein a liquid state may or may not be achieved until the exothermic spike has occurred.

For purposes of simplifying further description, the starting compound materials utilized in the process of the present invention shall be referred to as the "initial compound" or "initial compounds". The second phase-forming reactants provided from the initial compound shall be referred to as the "primary reactants" or primary second phase-forming reactants", while additional second phase-forming reactants not provided from the initial compound shall be referred to as the "secondary reactants" or "secondary second phase-forming reactants". The nonreactive metal present in the second phase-forming reaction shall be referred to as the "solvent metal". The metal-second phase material produced directly by the method of the present invention shall be referred to as the "composite", while the matrix of the composite shall be referred to as the "solvent metal matrix". In the further process, wherein metal-second phase composite material produced by the method of the present invention is added to additional metal, the composite, as added, shall be referred to as the "intermediate composite", while the metal with which the intermediate composite may be admixed shall be referred to as the "host metal". The material resulting from such an admixture shall be referred to as the "final composite", while the metal matrix of the final composite may be referred to as the "final metal matrix". In each instance, the word "metal" shall encompass the alloys and intermetallic compounds thereof. Further, the solvent metal may encompass not only metals in which the primary and secondary reactants are soluble, but also such metals in combination with other metals. Other metals may include those in which said reactants are not soluble, but in which said solvent metal is soluble, or which are soluble in said solvent metal. Thus, "solvent metal" may refer to a combination of solvent metals and nonsolvent metals.

Exemplary of suitable initial compoud materials and second phase precipitates are ceramics such as borides, carbides, oxides, nitrides, silicides, and sulfides, and intermetallics such as aluminides. Additionally, suitable initial compounds include boron oxide, copper oxide, aluminum carbide and aluminum boride. Suitable secondary reactants include the elements which are reactive to form second phase materials, including, but not limited to, transition elements of the third to sixth groups of the Periodic Table. Particularly useful secondary reactants include aluminum, titanium, silicon, boron, molybdenum, tungsten, niobium, vanadium, zirconium, chromium, hafnium, yttrium, cobalt, nickel, iron, magnesium, tantalum, thorium, scandium, lanthanum and rare earth elements. The secondary reactants of the present invention may be provided in elemental form, or may be provided as an alloy with either a reactive or nonreactive metal.

An example of an elemental secondary reactant is in the reaction:

$$BN+Ti+Al \rightarrow TiB_2+TiN+Al$$

wherein elemental titanium is utilized in the reaction between boron nitride and titanium in the presence of aluminum to form titanium diboride and titanium nitride second phase particles in an aluminum matrix.

An example of secondary reactants provided as an alloy of reactive metals is in the reaction:

$$BN+Ti/Zr+Al \rightarrow TiB_2+TiN+ZrB_2+ZrN+Al$$

wherein a titanium-zirconium alloy may be reacted with boron nitride in the presence of aluminum to form mixed borides and nitrides of titanium and zirconium in an aluminum matrix.

Exemplary of a secondary reactant provided as an alloy of a nonreactive metal is in the reaction:

$$BN+Ti/Zn+Al \rightarrow TiB_2+TiN+Al/Zn$$

wherein a titanium-zinc alloy is reacted with boron nitride in the presence of aluminum to form titanium diboride and titanium nitride particles in an aluminum-zinc alloy matrix.

As the solvent metal, one may use a metal capable of dissolving or sparingly dissolving the second phase-forming reactants, and having a lesser capability for dissolving the second phase precipitates. Thus, the solvent metal component must act as a solvent for the specific reactants, but not for the desired second phase precipitates. It is to be noted that the solvent metal acts primarily as a solvent in the process of the present invention, and that the second phase-forming reactants have a greater affinity for each other than for the solvent metal, which does not react significantly with the second phase dispersoids within the time frame of the exothermic excursion. Additionally, it is generally important that the second phase-forming reaction releases sufficient energy for the reaction to go substantially to completion. However, in those instances where the initial compound has a very negative free energy of formation, the second phase-forming reaction may need to be externally driven to completion by applied heat. It must be noted that while a large number of combinations of matrices and dispersoids may be envisioned, the choice of in-situ precipitated second phase in any one given matrix is limited by these criteria.

Suitable solvent metals include aluminum, nickel, titanium, copper, vanadium, chromium, manganese, cobalt, iron, silicon, molybdenum, beryllium, silver, gold, tungsten, antimony, bismuth, platinum, magnesium, lead, zinc, tin, niobium, tantalum, hafnium, zirconium, and alloys of such metals.

Either single or multiple second phases may be produced by the process of the present invention. Exemplary of a second phase-forming reaction which could be carried out in a solvent metal, such as aluminum, to form a distribution of a single second phase material is: ti $TiAl_3+B+Al \rightarrow TiB_2+Al$ wherein $TiAl_3$ intermetallic initial compound is reacted with boron secondary reactant in the presence of aluminum solvent metal to produce a substantially uniform distribution of $TiB_2$ particles in an aluminum solvent metal matrix. Additional reactions which result in the formation of a distribution of a single second phase material include:

$$AlB_{12}+Ti+Al \rightarrow TiB_2+Al$$

$$AlN+Ti+Al \rightarrow TiN+Al$$

$$CuO+Zr+Al \rightarrow ZrO_2+Al/Cu$$

Exemplary second phase-forming reactions which could be carried out in solvent metal, such as aluminum, to form distributions of multiple second phase materials are:

$$BN+Ti+Al \rightarrow TiB_2+TiN+Al$$

$$B_4C+Ti+Al \rightarrow TiB_2+TiC+Al$$

$$B_2O_3+Ti+Al \rightarrow TiB_2+TiO_2+Al$$

$$BeO+Ti+Al \rightarrow TiBe_2+TiO_2+Al$$

wherein various initial compounds are reacted with Ti secondary reactant in the presence of aluminum solvent metal to form a bimodal distribution of second phase materials in an aluminum solvent metal matrix. Thus, composites may be produced from a single second phase-forming reaction having distributions of multiple second phase particulates. The production of multiple second phase materials allows for the formation of particulates of differing composition, size, morphology, amount, etc. For example, in the above reaction between boron nitride initial compound and titanium secondary reactant in the presence of aluminum solvent metal to form titanium diboride and titanium nitride second phase in an aluminum solvent metal matrix, the titanium diboride may be formed as essentially equiaxed particles while the titanium nitride may be formed as needle shaped particles, resulting in a combination of dispersion strengthening and high temperature creep resistance.

In systems wherein distributions of aultiple second phase materials are produced, it is possible to control the stoichiometric ratio of the second phases within the composite by the addition of more of one second phase-forming reactant. For example, in the above reaction between $B_2O_3$ initial compound and Ti secondary reactant in the presence of aluminum solvent metal to form $TiB_2$ and $TiO_2$ second phases in an aluminum solvent metal matrix, it is possible to control the $TiB_2/TiO_2$ ratio in the metal-second phase composite by the addition of boron prior to initiation of the second phase-forming reaction. Alternatively, more elaborate metal-second phase systems can be produced by using multiple initial compounds, for example, a combination of BN, $B_4C$, $B_2O_3$ initial compounds and titanium secondary reactant may be reacted in the presence of aluminum solvent metal to form $TiB_2$, TiN, TiC, and Ti-oxide second phases all in one aluminum solvent metal matrix.

The reaction initiation temperature has, for the in-situ second phase-forming reaction, generally been found to be relatively close to the melting temperature of the solvent metal utilized in liquid state reactions. While it is unnecessary to actually reach the melting temperature to initiate the reaction, a temperature where localized melting occurs or where substantial diffusion of the primary and secondary reactants in the solvent metal can occur must be achieved. In some cases, as temperature increases it is possible for the reactants to diffuse into the solvent metal, forming an alloy therewith having a lower melting temperature than the solvent metal. Thus, reaction initiation temperature is lowered.

It is also possible to achieve a low temperature solvent assisted reaction in a metal matrix which has a high melting temperature by alloying or admixing the high melting metal with a lower melting solvent metal. This may allow for easier initiation and propagation.

Three modes for initiating the exothermic reaction involved in the process of the present invention have been identified. In the first mode, powders of the initial compound, secondary reactant, and solvent metal are mixed, followed by bulk heating to initiate the exothermic reaction. In the second mode, initial compound, secondary reactant and solvent metal powders are mixed and compacted, followed by local ignition to initiate an exothermic reaction which may propagate through the compact. In the third mode, compacted powders of the initial compound, secondary reactant and solvent metal are added to a aolten bath of metal which is at a sufficient temperature to initiate the exothermic reaction of the reactants.

The first, or bulk heating mode, comprises mixing powders of the initial compound, secondary reactant, and solvent metal followed by bulk heating of the mixture in a furnace, plasma device, or other suitable means, to initiate the exothermic second phase-forming reaction. Compaction of the powders prior to firing is not necessary, but doing so allows easier diffusion and thus initiation at lower temperatures. The temperature required to initiate the reaction is generally close to the melting point of the solvent metal. However, in systems where the primary and secondary reactants have substantial diffusivity in the solid solvent metal, the reaction may be initiated at temperatures below the melting point of the solvent metal. Bulk heating of the reactant mixture is preferably carried out under an inert atmosphere to minimize the formation of unwanted oxides. When a plasma device is used to initiate the second phase-forming reaction, a compacted and granulated mixture of the initial compound, secondary reactant and solvent metal may be introduced into a plasma flame, or alternatively, an arc may be struck between two electrodes, one for example, comprising a mixture of the solvent metal and the initial compound and the other comprising a mixture of the solvent metal and at least one secondary reactant.

The second, or local ignition mode, comprises mixing and compressing powders of the initial compound, secondary reactant, and solvent metal to form a green compact, followed by local ignition to initiate a substantially isothermal wave front which moves along the compact. The propagating reaction results in the in-situ precipitation of substantially insoluble second phase particles in the solvent metal to form the metal-second phase composite. The substantially isothermal wave front, which promotes uniformity of second phase particle size, results from the high thermal conductivity of the solvent metal, in combination with concentrations of the solvent metal sufficient to achieve an isothermal character across the material to be reacted.

In the local ignition mode, the heat generated by the initial local reaction of the second phase-forming reactants must be sufficient to allow the reaction wave front to propagate through the reaction mass. In addition, the heat source, such as inductively heated graphite, should supply sufficient local heat to initiate the second phase-forming reaction by, for example, locally melting solvent metal. Both of the preceeding criteria have a significant impact on the feasibility of different composite forming reactions performed in accordance with the local ignition method, because the relatively high volume fractions of solvent metal in the reaction mass absorb heat and therefore tend to quench the reaction. For this reason, it may be necessary to preheat the reactant mass prior to local initiation of reaction. Preheating may thus permit certain non-propagating reactions to propagate, or, in the alternative, allow reactions to propagate at higher solvent metal concentrations. Other advantages of preheating include the ability to remove adsorbed gases from the reaction mass prior to initiation, and the attainment of higher maximum reaction temperatures that permit the second phase-forming reaction to go substantially to completion.

Alternatively, in the local ignition mode, in some cases it may be necessary to heat the reaction mass ahead of the reaction wave front in order to sustain the propagating reaction. This may be achieved by moving the ignition source such as an induction coil along the green compact as the reaction propagates. This technique provides a method for effectively preheating a localized portion of the reaction mass just ahead of the reaction wave front and achieves the benefits of preheating as discussed above.

The third, or direct addition mode, comprises adding a preform or compact of the initial compound, secondary reactant, and solvent metal powders directly to a molten matrix metal and recovering a composite comprising substantially unagglomerated particles of the second phase in a final matrix. It is noted that a solvent metal must be present in the preform or compact to facilitate the reaction of second phase-forming reactants. The solvent metal may be either the same as or different than the molten matrix metal, and thus, the final matrix composition may be the same as the molten matrix metal, or an alloy of the solvent metal and the matrix metal. In comparison to the bulk heating and local ignition modes, the direct addition mode generally produces composites of lower second phase loading since the second phase particles, which are formed in the presence of the solvent metal, are subsequently dispersed in an additional volume of matrix metal.

An advantage of this direct addition procedure is that if the reactants are added to a relatively large pool of aolten metal in a step-wise or incremental fashion, for example, the temperature of the molten matrix metal will not change significantly during the course of the addition. Thus, potential particle growth of the second phase particles will be minimized since elevated temperatures will only occur locally, will be quenched rapidly by the large thermal mass, and will be minimized in the bulk of the melt. Such an addition procedure is also advisable from a safety standpoint to prevent the rapid evolution of significant quantities of heat, which could cause metal to be splattered, sprayed or boiled from the containment vessel. Another advantage is that the exothermic reaction of the reactants creates a mixing effect. This, together with the concomitant expansion of adsorbed and produced gases, aids in dispersing the second phase material throughout the mass. In addition, by having the mass molten or liquid upon addition of the reactants, the reactants are rapidly heated to reaction temperature. This promotes the formation of fine second phase particles. A further important consideration of this procedure is that because a molten mass of matrix metal is utilized, the matrix metal need not be formed from powdered metal, but may be formed from ingot, scrap, etc., thus resulting in a significant saving in material preparation costs.

In selecting the initial compound, secondary reactant, and solvent metal for the composite materials produced by the process of the present invention, it is important that the formed second phase material have a low solubility in the molten mass, for example, a maximum solubility of about 5 weight percent, and preferably 1 percent or less, at the temperature of the molten solvent metal. Otherwise, significant particle growth in the second phase material may be experienced over extended periods of time at temperature. For most uses of composite materials, the size of the second phase particles should be as small as possible, and thus particle growth is undesirable. When the solubility of the formed second phase material in the molten mass is low, the molten mass with dispersed second phase particles can be maintained in the molten state for considerable periods of time without growth of the second phase particles.

The starting powders must be protected from extensive oxidation due to exposure to the atmosphere, as oxide films around the initial compound and secondary reactant powders may act as barriers to diffusion and reaction. Also, the reaction should preferably be carried out under an inert gas to minimize oxidation at elevated temperatures. In addition, extraneous contaminants, such as absorbed water vapor, may yield undesirable phases such as oxides or hydrides, or the powders may be oxidized to such an extent that the reactions are influenced.

The particle size of the second phase reaction product is dependent upon heat-up rate, reaction temperature, cool-down rate, crystallinity and composition of the starting materials. Appropriate starting powder sizes may range from less than 5 microns to more than 200 microns. For economic reasons, one may normally utilize larger particle size powders. It has been found that the particle size of the precipitated second phase in the solvent metal matrix may vary from less than about 0.01 microns to about 5 microns or larger.

The cool-down period following initiation of the reaction and consumption of the primary and secondary reactants is believed important to achieving very small particle size, and limiting particle and solvent metal matrix grain growth. It is known that at high temperatures, it is possible for the second phase particles to grow, or sinter together. This should also be avoided, in aost cases, because of the negative effect of large particle sizes on ductility. The cool-down or quenching of the reaction is, in a sense, automatic, because once the primary and secondary reactants are completely reacted, there is no further energy released to maintain the high temperatures achieved. However, one may control the rate of cool-down to a certain extent by control of the size and/or composition of the mass of material reacted. That is, large thermal masses absorb more energy, and cool down more slowly, thus permitting growth of larger particles, such as may be desired for greater wear resistance, for example, for use in cutting tools. Fast cooling is typically more desirable and may be achieved in the local ignition mode, for example, by placing the reaction mass on a water-cooled copper substrate. This avoids the contamination typically obtained with refractory substrates such as alumina.

The degree of porosity of the composites produced by the bulk heating and local ignition modes of the present invention can be varied by procedures such as vacuum degassing or compression applied prior to, during, or subsequent to initiation of the second phase-forming reaction. The degree of vacuum applied and temperature of the degassing step is determined purely by the kinetics of evaporation and diffusion of any absorbed moisture or other gases. High vacuum and elevated temperatures aid the degassing operation. When vacuum degassing is applied prior to reaction, trapped gases, which would otherwise expand during the reaction and thereby create voids, are removed, resulting in lower porosity. When vacuum is applied during reaction, gases produced by the reaction rapidly expand in an attempt to fill the vacuum, resulting in the expansion of the reaction mass and a significant increase in porosity of the resultant composite. Absent the degassing step prior to reaction, the composite formed may be relatively porous, and lower in density than the solvent metal. In preparing composite materials, degassing of the mixture of initial compound, secondary reactant, and solvent metal powders may not be necessary, and in cases where a porous composite is desired, it may be advantageous not to degas the powders. It may even be desirable, in some instances, to incorporate a porosity enhancer such as a low boiling point metal, e.g., zinc or magnesium in the initial reactant mixture, the enhancer volatilizing during the in-situ reaction, thereby increasing the porosity of the resultant composite.

An advantage of the present invention is that such composites may, in turn, be utilized via an admixture process to introduce the second phase into a host metal in controlled fashion. Thus, a composite may be prepared by the method of the present invention having a relatively high concentration of a second phase, such as mixed ceramics, e.g. titanium diboride and titanium nitride, in a solvent matrix metal, such as aluminum. This intermediate composite may then be added to a molten host metal, metal alloy or intermetallic bath, (which molten metal may be the same or different from the solvent metal matrix of the intermediate composite) to achieve a final composite having the desired loading of second phase. Intermediate composite material in the solid form can be comminuted to a convenient size prior to addition to the molten host metal, or the reaction melt may be introduced directly into the molten host metal without solidification. Alternatively, the intermediate composite may be admixed with solid host metal, metal alloy or intermetallic, and then heated to a temperature above the melting point of the host metal. Another alternative method for introducing intermediate composite material to the molten metal is by injection of finely crushed intermediate composite via an inert, e.g. argon, or reactive, e.g. chlorine, gas stream using a suitable lance. The use of reactive gases may also be desirable for removing oxygen and hydrogen from the melt. Dispersion of the second phase material in the melt is facilitated by melt agitation generated by mechanical stirring, gas bubbling, induction stirring, ultrasonic energy, and the like. In the following discussion, admixture with a "host metal" or "host metal bath" should be understood to apply equally to each of the different embodiments indicated above.

The temperature of the host metal should preferably be above the melting point of the solvent metal matrix, and there must be sufficient miscibility of the two molten metals to insure alloying, dissolution, or combination. For example, titanium can be reinforced by precipitating titanium diboride and titanium nitride in aluminum, and subsequently introducing the titanium diboride/titanium nitride-aluminum intermediate composite into molten titanium to dissolve the aluminum matrix of the intermediate composite, thus forming an aluminum-titanium alloy final metal matrix having titanium diboride and titanium nitride dispersed therein. Similarly, lead can be reinforced by precipitating titanium diboride and titanium nitride in aluminum and admixing the intermediate composite with molten lead above the melting point of aluminum. It is possible to dissolve a solvent metal matrix having a higher melting point in a host metal of lower melting point at a temperature below the melting point of the solvent metal matrix provided there is sufficient liquid solubility for the solid solvent metal matrix into the host metal, by, for example, crushing the intermediate composite to increase the exposed surface area of metal for dissolution, prior to addition to the host metal.

The host metal may be any metal in which the second phase precipitate is not soluble, and with which the second phase does not react during the time/temperature regime involved in the admixture process, subsequent fabrication, and/or recasting. The host metal must be capable of dissolving or alloying with the solvent metal, and must wet the intermediate composite. Thus, the host metal may be the same as the solvent metal, an alloy of the solvent metal, or a metal in which the solvent metal is soluble. When alloys are utilized as the host metal, one may substantially retain the beneficial properties of the alloys, and increase, for example, the modulus of elasticity, high temperature stability, and wear resistance, although some loss of ductility may be encountered in certain soft alloys. Further, the final composites prepared from the composite materials of the present invention may be fabricated in conventional fashion, by casting, forging, extruding, rolling, machining, etc., and may also be remelted and recast while retaining substantial uniformity in second phase particle distribution, fine second phase particle size, fine grain size, etc., thereby maintaining associated improvements in physical and mechanical properties. Aluminum-lithium alloys are of particular interest as host metals due to their high modulus and low density characteristics. With each weight percent addition of lithium to aluminum, density decreases by almost 6 percent. Further, lithium greatly reduces the surface energy of molten aluminum, which is believed to aid in the wetting and infiltration of the intermediate composites as they are contacted by molten aluminum-lithium host metal.

Further, the molten host metal may be of such composition that in-situ precipitation of the desired second phase could not occur within the bath, or could occur only with difficulty. Thus, metals other than the solvent matrix metal may be provided with a uniform dispersion of second phase particles of submicron and larger size. The molten host metal may also be the same as the solvent metal matrix of the intermediate composite, but of so great a volume, as compared to the intermediate composite, that in-situ second phase precipitation would be difficult to effect or control. The concentration of the second phase in the intermediate composite need not be large, however.

The second phase concentration or loading in composites produced by the bulk heating and local ignition modes of the present invention is generally rather high, for example, at least about 10 weight percent, up to 80 or 90 weight percent or more, of second phase material in the resultant composite. Generally, concentrations below about 10 weight percent are not feasable because the relatively high proportion of solvent metal tends to quench the second phase-forming reaction, resulting in an insufficient exotherm for the reaction to go to completion. Additionally, concentrations below about 10 weight percent may be impractical for further dilution in a subsequent admixture process. Concentrations in excess of about 90 percent are not advisable, as agglomeration, particle growth, and sintering may inhibit uniform particle distribution dependent upon the specific metal/second phase system.

One advantage of the admixture process is that the use of a given metal-second phase composite, particularly one having a high loading of second phase material, permits one to simply make a single batch of intermediate composite material from which to produce a wide variety of final composites having different second phase loadings. Additionally, with the admixture procedure, it is possible to form the second phase material in a solvent metal matrix which is conducive to the formation of particles of a desired type, size, and morphology, and thereafter incorporate the particles in a host metal in which such particles cannot otherwise be produced.

Varying amounts of the second phase material may be incorporated into the final composite depending upon the end use and the properties desired in the product. For instance, to produce dispersion strengthened alloys having high modulus, one may utilize a range of about 0.1 to about 30 percent by volume, and preferably from about 5 to about 15 percent by volume of second phase. However, for purposes other than dispersion strengthening, the second phase volume fraction may be varied considerably, to produce a final composite with the desired combination of properties, within the range of from about 0.1 percent by volume up to the point at which ductility is sacrificed to an unacceptable extent. The primary determining factors of the composition of the final composite will be the intended use of the products. Thus, for example, for uses such as cutting tools, the determining properties will be the wear and chip resistance of the final composite material produced. It is possible to effectively tailor the composition to achieve a range of desired properties by controlling the proportions of the primary and secondary reactants, solvent metal, and host metal. An advantage of the use of the admixture concept is related to the fact that in the in-situ precipitation of second phase material in a solvent metal matrix, the particle size of the second phase material appears to be related to the loading level of the second phase material. For example, in titanium diboride/titanium nitride-aluminum composites, particle size decreases with higher concentration, up to about 40–60 percent second phase material, and then the particle size increases as the concentration approaches 100 percent. Thus, for example, if the smallest possible particle size was desired in a final composite having a low second phase concentration, one could prepare a second phase-containing concentrate in the 40–60 percent concentration range of titanium diboride and titanium nitride to yield the smallest particles possible, and thereafter admix the composite to the desired second phase concentration.

Particle size considerations influence the amount of strengthening that is achievable and have a direct impact on the grain size of the final metal matrix. The interparticle spacing of the dispersoids, which in general controls the grain size of the final matrix, varies with the volume fraction and size of the dispersoid. Thus, relatively high loadings of very fine second phase particles produce the finest grained final composite materials. Typically the grain size of the final composite is in the vicinity of one micron for second phase volume fractions between 5 percent and 15 percent. Fine grain size is extremely important, for example, in precision casting and in applications where fatigue resistance is required.

Further, the admixture process may be used to obtain metal-second phase composites wherein the matrix metal is toxic or dangerous to work with. For example, hot beryllium is highly toxic, and the use of a highly exothermic reaction to precipitate a second phase in-situ in beryllium could be extremely hazardous. Accordingly, a solvent metal of copper may be utilized in the reaction between boron and carbon primary reactants provided from a boron carbide initial compound and titanium secondary reactant to form an intermediate composite comprising titanium diboride and titanium carbide second phase particles dispersed in a copper solvent metal matrix. The solvent metal matrix of the thus produced intermediate composite may then be dissolved in beryllium, providing a beryllium matrix, alloyed with copper, said matrix having evenly dispersed submicron titanium diboride and titanium carbide second phase dispersoids therein. Beryllium second phase composites produced by this approach will have fine grain size and exhibit improved low temperature ductility.

In certain instances, the "host metal" may comprise material other than conventional metals, metal alloys or intermetallics. The host metal may, for example, be a dispersion strengthened metal such as metal containing finely dispersed erbium oxide, thoria, alumina, etc., or a metal-second phase composite per se. Therefore, final composites produced from intermediate composites of the present invention are suitable for use as host metals. It is important in these cases that the preexisting dispersion be stable in the molten host metal for the time/temperature required for introducing the desired composite material of the present invention. An advantage of utilizing a material already containing a second phase dispersion as the host metal is that a distribution of multiple second phases of varying composition, shape, morphology, amount, etc., which could not otherwise be produced, may be obtained. In accordance with the foregoing discussion, it must be understood that suitable "host metal," or "host metal, metal alloy or intermetallic" matrices encompass the types of materials discussed above containing preexisting second phase dispersions.

It should be noted that the metal-second phase products of the present invention are also suitable for use as matrix materials, for example, in long fiber reinforced composites. Thus, for example, a particulate reinforced aluminum composite of the present invention may be used in conjunction with long SiC or carbon fibers to enhance specific directional properties. Typical fabrication routes for such materials include diffusion bonding of thin layed-up sheets, and molten metal processing. For molten metal processing, advantage may be taken of enhanced metal wetting by the composite compared to the unmodified metal absent second phase material.

Composites produced by the process of the present invention may be used to further produce high purity ceramic powders of desired particle size, morphology, and composition. This may be achieved by dissolving the solvent metal matrix away from the composite, leaving the second phase dispersoids, which, due to in-situ precipitation, may inherently possess superior properties over prior art ceramic powders. For example, a composite produced by the process of the present invention, containing titanium diboride and titanium nitride dispersoids in an aluminum solvent metal matrix, may be immersed in hydrochloric acid to dissolve the aluminum matrix, leaving titanium diboride and titanium nitride particles having very small size, e.g. 0.1 to 1.0 micron.

The present invention is directed to a novel process for the in-situ precipitation of fine particulate second phase materials, such as ceramics or intermetallics, typical of which are refractory hard metal borides, carbides and nitrides, or aluminides, within metal, alloy, and intermetallic systems, to produce a solvent metal-second phase composite suitable for use as a master concentrate in the admixture process. However, the process described may also be used for introducing larger particles of a second phase material into molten host metal, up to the point at which such larger particles result in component embrittlement, or loss of ductility, etc. The improved properties of the novel final composites offer weight-savings in stiffness limited applications, higher operating temperatures and associated energy efficiency improvements, and reduced wear in parts subject to erosion. A specific use of such material is in the construction of turbine engine components, such as blades.

It is noted that in the bulk heating and local ignition modes of the present invention undesirable compounds which may be formed from the reaction of one reactant and the solvent metal or which may be present as an unreacted portion of reactant material during the composite formation process can be essentially eliminated in some instances by the addition of more of another reactant. For example, in a titanium diboride/titanium nitride-aluminum composite, formed by mixing and compacting boron nitride initial compound, titanium secondary reactant, and aluminum solvent metal powders and either bulk heating or locally igniting to initiate the second phase-forming reaction, the formation of titanium aluminide may be substantially eliminated by providing boron above stoichiometric proportion prior to initiation of the reaction. The boron can be provided as excess boron nitride initial compound or may be added in the form of elemental boron, boron alloy or boron halide. It is also noted that in the admixture process, wherein composite material produced by the bulk heating or local ignition modes of the present invention is added to a molten host metal, undesirable compounds present in the intermediate composite may be introduced into the melt. These undesirable compounds may be essentially eliminated by adding an additional amount of another reactant to the molten host metal. For example, titanium aluminide formed in a titanium diboride/titanum nitride-aluminum intermediate composite may be essentially removed from a host aluminum melt by adding additional boron to the melt. Such a boron addition also provides the benefit that any free titanium, which can adversely affect the viscosity of the melt for casting operations, is converted to titanium diboride.

Similarly, in the direct addition mode of the present invention, it is preferable that essentially all of the primary and secondary reactants are consumed in the precipitation reaction, i.e., that essentially no unreacted reactants remain after the completion of the reaction. In most instances, this requirement can be met if the initial compound and secondary reactants are provided in the preform or compact in such amounts that stoichiometric quantities of the primary and secondary reactants are available. However, it may be advantageous to provide one reactant above stoichiometric proportion in the preform or compact or in the molten matrix metal to essentially eliminate unwanted products which may be formed from the reaction of another reactant and the solvent metal or the matrix metal. For example, in a titanium diboride/titanium nitride-aluminum composite formed by the direct addition of a compact comprising boron nitride initial compound, titanium secondary reactant, and aluminum solvent metal to molten aluminum matrix metal, titanium aluminide which may be formed can be removed by adding additional boron to the molten mass of aluminum, or by providing additional boron in the compact prior to addition to the molten aluminum. The boron can be in the form of elemental boron, boron alloy or boron halide, or may be provided as an excess amount of boron nitride initial compound.

The following examples illustrate various characteristics and aspects of the invention as discussed hereinabove.

EXAMPLE 1

A stoichiometric mixture of BN initial compound, Ti secondary reactant, and aluminum solvent metal powders is compacted and heated to ignition at about 730° C., marked by a sudden temperature rise. X-ray and SEM analyses confirm the complete conversion of the BN to $TiB_2$ and TiN at a second phase loading of about 20% by weight. The particle size of the second phase is in the range 1–10 microns.

EXAMPLE 2

A similar experiment to the one described in Example 1 is performed except that copper is used as the solvent metal. Ignition in copper occurs at about 900° C. Again, X-ray and SEM analyses confirm the conversion of the BN to $TiB_2$ and TiN at a second phase loading of about 70%. The particle size of the precipitate in the copper system is less than 1 micron.

EXAMPLE 3

In another test $B_4C$ initial compound is combined with Ti secondary reactant in copper solvent metal. Ignition occurs at about 850° C. and subsequent analyses confirm the conversion of the $B_4C$ to $TiB_2$ and TiC at a level of about 40%.

EXAMPLE 4

$B_2O_3$ is also examined as a starting material. The objective is to reduce the cost per unit of boron in the second phase. Specifically, a stoichiometric $B_2O_3$ initial compound and Ti secondary reactant mix in aluminum solvent metal is heated to ignition at about 710° C., marked by a sudden temperature rise. Subsequent analyses confirm the consumption of both reactants, but the crystallographic form of the reaction products is not immediately discernable; complex ceramic phases are formed.

EXAMPLE 5

Two experiments are performed using $AlB_{12}$ initial compound, Ti secondary reactant and Al solvent metal to produce a composite comprising $TiB_2$ second phase particles in an Al solvent metal matrix. In one experiment, 26.9 grams of $AlB_{12}$ powder (−200 mesh), 49.3 grams of Ti powder (−325 mesh) and 23.8 grams of Al powder (−325 mesh) are ball milled for 30 minutes, packed in gooch tubing and isostatically pressed to 42,000 psi. The compact is placed on two water cooled copper rails in a quartz tube under flowing argon and inductively heated to initiate an exothermic reaction. X-ray and SEM analyses of the resultant composite reveal $TiB_2$ particles having an approximate size range of 0.2–0.5 microns dispersed in an aluminum matrix. The second experiment is performed as above except that 20.6 grams of $AlB_{12}$, 36.4 grams of Ti and 43.2 grams of aluminum are used to produce a composite having a 40 volume percent loading of $TiB_2$ in an aluminum matrix. As in the previous experiment, X-ray and SEM analyses reveal a dispersion of submicron $TiB_2$ particles throughout an aluminum matrix.

EXAMPLE 6

Powders of AlN initial compound, Ti secondary reactant and Al solvent metal in the proper stoichiometric proportions to produce a composite comprising 60 weight percent TiN second phase particles in an aluminum matrix are ball milled and then compacted to 40 ksi. The compact is placed on a water cooled copper boat in a quartz tube under flowing argon and inductively heated to initiate an exothermic reaction. The resultant composite comprises TiN particles of a generally rod-like shape in an aluminum matrix.

EXAMPLE 7

Powders of $TiAl_3$ initial compound, B secondary reactant and Al solvent metal in the proper stoichiometric proportions to produce a composite comprising 30 weight percent $TiB_2$ second phase particles in an aluminum matrix are ball milled and then compacted. The compact is then heated in an induction unit under an argon atmosphere to initiate an exothermic reaction. The resultant composite comprises $TiB_2$ particles having a size of approximately one micron in an aluminum matrix.

It is believed that the prior art suggestions of introduction of fine second phase particles directly to a molten metal bath are technically difficult and produce metal products having less desirable properties upon solidification due to a deleterious layer, such as an oxide, which forms on the surface of each second phase particle at the time of, or prior to, introduction into the molten metal bath. The second phase particles of the present invention, being formed in-situ, do not possess this deleterious coating or layer. Thus, the present invention leads to metal products having unexpectedly superior properties.

The process of the present invention offers a number of advantages over methods taught by the prior art. For example, this invention circumvents the need for submicron, unagglomerated refractory metal boride starting materials, which materials are not commercially available, and are often pyrophoric. The processing steps of the present invention are relatively simple and generally involve the use of low cost starting materials. Further, the present invention provides a method for the dispersion of multiple second phase materials in a metal matrix. In addition, the present invention yields a composite with second phase material precipitated therein, suitable for admixture with a host metal to achieve a final composite having superior hardness and modulus qualities over currently employed composites, such as SiC/aluminum. This admixture process also eliminates the technical problems of uniformly dispersing a second phase in a molten metal, and avoids the problem of oxide or other deleterious layer formation at the second phase/metal interface during processing. Final metal matrix composites prepared from the solvent metal matrix-second phase composites of the present invention also have improved high temperature stability, in that the second phase is not reactive with the final metal matrix.

Final composites prepared from solvent metal matrix-second phase composites of the present process may be fabricated in substantially conventional fashion, by casting, forging, extruding, rolling, machining, etc. The final composites may also be remelted and recast while retaining substantial uniformity in second phase particle distribution, retaining fine second phase particle size, fine grain size, etc., thereby maintaining associated improvements in physical and mechanical properties. Aside from the obvious benefits in subsequent processing and fabrication, the ability to remelt and recast these materials permits recycling and reuse thereof, unlike known prior art metal-ceramic composites. Further still, the final composites can be welded without degradation of material properties, and after welding possess superior corrosion resistance, when compared to metal matrix composites presently available.

The use of relatively inexpensive initial compound materials in the production of composite materials of the present invention offers considerable savings in raw material cost, providing an economical alternative to the use of elemental metal powders.

It is understood that the above description of the present invention is susceptible to considerable modification, change, and adaptation by those skilled in the art, and such modifications, changes, and adaptations are intended to be considered to be within the scope of the present invention, which is set forth by the appended claims.

We claim:

1. In a method for the production of metal-second phase composite materials, the method comprising precipitating second phase material in a solvent metal matrix by contacting at least one primary second phase forming reactant and at least one secondary second phase-forming reactant in the presence of a substantially nonreactive solvent metal in which the second phase-forming reactants are more soluble than the second phase material, at a temperature at which sufficient diffusion of the reactants into the solvent metal occurs to cause a second phase-forming reaction of the reactants to thereby precipitate second phase material in the solvent metal, and recovering a metal-second phase composite material, the improvement comprising providing said at least one primary reactant from an initial compound.

2. The method of claim 1, wherein the initial compound, at least one secondary reactant, and solvent metal are provided as powders.

3. The method of claim 2, wherein the powders are premixed and compacted.

4. The method of claim 1, wherein the initial compound is boron nitride, boron carbide, boron oxide, aluminum nitride, aluminum carbide, aluminum boride, silicon carbide, silicon nitride, copper oxide, iron oxide, titanium aluminide, or nickel aluminide.

5. The method of claim 1, wherein the solvent metal is aluminum, copper, iron, magnesium, or an alloy thereof.

6. The method of claim 1, wherein at least one secondary reactant is provided in elemental form.

7. The method of claim 1, wherein at least one secondary reactant is provided in an alloy of the solvent metal.

8. The method of claim 1, wherein at least one secondary reactant is provided in an alloy of a reactive metal.

9. The method of claim 1, wherein the second phase material is a ceramic.

10. The method of claim 1, wherein the second phase is an intermetallic.

11. The method of claim 1, wherein the second phase material is particulate and is substantially uniformly distributed throughout the solvent metal matrix.

12. The method of claim 11, wherein the particulate second phase is titanium diboride, zirconium diboride, zirconium disilicide, titanium oxide, titanium carbide, titanium nitride or a mixture thereof.

13. The method of claim 12, wherein the second phase is submicron in size.

14. The method of claim 13, wherein the second phase-forming reactants are contacted in stoichiometric proportions.

15. The method of claim 13, wherein one second phase-forming reactant is provided in greater than stoichiometric proportion.

16. The method of claim 13, wherein the concentration of the second phase material is from about 10 to about 90 volume percent.

17. The method of claim 1, wherein said initial compound comprises aluminum boride, said secondary reactant comprises titanium, and said second phase material comprises titanium diboride.

18. The method of claim 1, wherein plural primary reactants are provided from multiple initial compounds.

19. The method of claim 1, wherein said second phase material comprises material of at least two different compositions.

20. The method of claim 19, wherein said initial compound comprises boron nitride, said secondary reactant comprises titanium, and said second phase material comprises titanium diboride and titanium nitride.

21. The method of claim 19, wherein said initial compound comprises boron carbide, said secondary reactant comprises titanium, and said second phase material comprises titanium diboride and titanium carbide.

22. In a method for the production of metal-second phase composite materials, the method comprising precipitating second phase material in a solvent metal matrix by contacting at least two primary second phase-forming reactants in the presence of a substantially nonreactive solvent metal in which at least one of the second phase-forming reactants is more soluble than the second phase material, at a temperature at which sufficient diffusion of said at least one reactant into the solvent metal occurs to cause a second phase-forming reaction to thereby precipitate second phase material in the solvent metal, and recovering a metal-second phase composite material, the improvement comprising providing said at least two primary reactants from at least two initial compounds.

23. The method of claim 22, wherein the initial compounds and solvent metal are provided as powders.

24. The method of claim 23, wherein the powders are premixed and compacted.

25. The method of claim 22, wherein the second phase material is particulate and is substantially uniformly distributed throughout the solvent metal matrix.

26. A method for precipitation of second phase material in a solvent metal matrix, the method comprising steps of:

(a) preparing a mixture of an initial compound, at least one secondary second phase-forming reactant, and a substantially non-reactive solvent metal in which at least one secondary second phase-forming reactant is more soluble than the second phase, said initial compound comprising at least one primary second phase-forming reactant;

(b) heating the mixture to a reaction initiation temperature approximating the melting point of the solvent metal to initiate an exothermic reaction;

(c) permitting the exothermic reaction to further heat the mixture, consuming the second phase-forming reactants, and to form a substantially uniform distribution of second phase particles in the solvent metal matrix; and (d) recovering a product.

27. The method of claim 26, wherein said initial compound, at least one secondary reactant, and solvent metal are provided as powders.

28. The method of claim 27, wherein the powders are premixed and compacted.

29. The method of claim 28, wherein initiation of the exothermic reaction is achieved by bulk heating of the mixture.

30. The method of claim 28, wherein initiation of the exothermic reaction is achieved by heating a substantially localized portion of the mixture.

31. The method of claim 28, wherein initiation of the exothermic reaction is achieved by introducing the mixture into a molten bath of matrix metal.

32. The method of claim 26, wherein the reaction takes place in the liquid state.

33. The method of claim 26, wherein the initial compound is selected from boron nitride, boron carbide, boron oxide, aluminum nitride, aluminum carbide, aluminum boride, silicon carbide, silicon nitride, iron oxide, copper oxide, titanium aluminide, or nickel aluminide.

34. The method of claim 26, wherein at least one second phase-forming reactant is a transition metal of the third to sixth groups of the Periodic Table.

35. The method of claim 26, wherein at least one second phase-forming reactant is aluminum, titanium, silicon, boron, carbon, sulfur, tantalum, thorium, yttrium, cobalt, nickel, molybdenum, tungsten, vanadium, zirconium, niobium, hafnium, magnesium, scandium, lanthanum, chromium, oxygen, nitrogen, lithium, beryllium, iron, manganese, zinc, tin, copper, silver, gold, platinum, or a rare earth element.

36. The method of claim 26, wherein at least one secondary second phase-forming reactant and the solvent metal are provided as individual elements.

37. The method of claim 26, wherein at least one secondary second phase forming reactant is provided as an alloy of the solvent metal.

38. The method of claim 26, wherein the solvent metal is aluminum, nickel, titanium, copper, vanadium, chromium, manganese, cobalt, iron, silicon, molybdenum, beryllium, silver, gold, platinum, niobium, tantalum, hafnium, zirconium, magnesium, lead, zinc, tin, tungsten, antimony, bismuth, or an alloy of such metals.

39. The method of claim 26, wherein the second phase material is ceramic.

40. The method of claim 26, wherein the second phase material is intermetallic.

41. The method of claim 26, wherein the second phase material is an oxide, nitride, boride, carbide, silicide, oxynitride, sulfide, oxysulfide, or a mixture thereof.

42. The method of claim 41, wherein the second phase material is titanium diboride, zirconium diboride, zirconium disilicide, titanium oxide, titanium carbide, titanium nitride, or mixtures thereof.

43. A method for precipitation of second phase material in a solvent metal matrix, the method comprising steps of:

(a) preparing a mixture of at least two initial compounds, each of which comprises at least one primary second phase-forming reactant, and a substantially non-reactive solvent metal in which at least one of said reactants are more soluble than the second phase;

(b) heating the mixture to initiate an exothermic reaction;

(c) permitting the exothermic reaction to further heat the mixture, consuming the second phase-forming reactants, and to form a substantially uniform distribution of second phase particles in the solvent metal matrix; and (d) recovering a product.

44. The method of claim 43, wherein said initial compounds and solvent metal are provided as powders.

45. The method of claim 44, wherein the mixture is compacted prior to heating.

46. The method of claim 45, wherein initiation of the exothermic reaction is achieved by bulk heating of the mixture.

47. The method of claim 45, wherein initiation of the exothermic reaction is achieved by heating a substantially locallized portion of the mixture.

48. The method of claim 45, wherein initiation of the exothermic reaction is achieved by introducing the mixture into a molten bath of matrix metal.

49. A method for dispersion of second phase dispersoids in a solvent metal matrix, the method comprising forming a reaction mixture of at least one primary second phase-forming reactant provided from an initial compound and at least one secondary second phase-forming reactant, in the presence of at least two metals, at least the lower melting of which acts as a solvent metal in which second phase-forming reactants are more soluble than the second phase dispersoids, raising the temperature of the reaction mixture to a temperature at which sufficient diffusion of the second phase-forming reactants into the solvent metal occurs to initiate a reaction of the reactants, whereby the exothermic heat of reaction of the reactants causes the temperature of the reaction mixture to exceed the melting point of the higher melting point metal, permitting dispersion of the second phase dispersoids in a mixed metal matrix, and recovering a product.

50. The method of claim 49, wherein the higher melting metal is cobalt, chromium, nickel, niobium, tantalum, titanium, vanadium, iron, or silicon.

51. The method of claim 50, wherein the lowest melting solvent metal is aluminum, copper, tin, zinc, lead or magnesium.

52. A method for dispersion of second phase dispersoids in a solvent metal matrix, the method comprising forming a reaction mixture of at least one primary second phase-forming reactant provided from an initial compound and at least one secondary second phase-forming reactant, in the presence of at least two metals, at least one of which acts as a solvent metal in which said second phase-forming reactants are more soluble than said second phase dispersoids, raising the temperature of the reaction mixture to a temperature at which sufficient diffusion of the second phase-forming reactants into the lowest melting solvent metal occurs to initiate a reaction of the reactants, whereby the exothermic heat of reaction of the reactants causes the temperature of the reaction mixture to exceed the melting point of the lowest melting point metal permitting dispersion of the second phase dispersoids in a mixed metal matrix and recovering a product.

* * * * *